United States Patent [19]

Wittrisch

[11] Patent Number: 4,729,429

[45] Date of Patent: Mar. 8, 1988

[54] HYDRAULIC PRESSURE PROPELLED DEVICE FOR MAKING MEASUREMENTS AND INTERVENTIONS DURING INJECTION OR PRODUCTION IN A DEFLECTED WELL

[75] Inventor: Christian Wittrisch, Rueil-Malmaison, France

[73] Assignee: Institut Francais du Petrole, France

[21] Appl. No.: 814,755

[22] Filed: Dec. 30, 1985

[30] Foreign Application Priority Data

Dec. 28, 1984 [FR] France ..... 84 19964

[51] Int. Cl.[4] ..... E21B 23/10

[52] U.S. Cl. ..... 166/65.1; 166/153; 166/332; 166/383; 166/385

[58] Field of Search ..... 166/65.1, 70, 153, 155, 166/156, 250, 332, 383, 385, 386

[56] References Cited

U.S. PATENT DOCUMENTS

| | | | |
|---|---|---|---|
| 3,070,167 | 12/1962 | Loy, III et al. | 166/153 |
| 3,104,714 | 9/1963 | Terrel et al. | 166/153 |
| 3,572,433 | 3/1971 | Conrad | 166/155 |
| 4,349,072 | 9/1982 | Esearon et al. | 166/383 |
| 4,457,370 | 7/1984 | Wittristch | 166/250 |
| 4,484,628 | 11/1984 | Lammon, II | 166/250 |
| 4,498,532 | 2/1985 | Mason | 166/70 |

*Primary Examiner*—James A. Leppink
*Assistant Examiner*—Hoang C. Dang
*Attorney, Agent, or Firm*—Antonelli, Terry & Wands

[57] ABSTRACT

A device for making measurements and interventions during fluid production or injection in a well passing through a geological formation is provided in tubing located in the well. The device has a propulsion position in the production tubing and a measuring or intervention position and comprises means supporting sealing members which are adapted on the one hand for uncovering an opening allowing fluid to flow along the tubing and an extension in said measuring or intervention position of the device and on the other for closing said opening in said propulsion position.

9 Claims, 9 Drawing Figures

6
27
21
21A
17
22
24
23
2
20
19
15
16
26
25

HYDRAULIC PRESSURE PROPELLED DEVICE FOR MAKING MEASUREMENTS AND INTERVENTIONS DURING INJECTION OR PRODUCTION IN A DEFLECTED WELL

BACKGROUND OF THE INVENTION

1. Field of the Invention

The present invention relates to a hydraulic pressure propelled device for carrying out measurements and interventions during injection or production in a deflected well.

By the expression "deflected well" is meant here not only wells which are slightly deflected but also those which are greatly deflected and which require pumping of the equipment to reach the production zone.

The invention is more especially applicable for carrying out measurements, for example of pressure and flow rate, at the level of geological formations or any other intervention in a well when it is a question of revealing the flow pattern of the productive part of a deflected blowout well. Such measuring techniques are well known by specialists and will not be described in greater detail here.

The measuring or intervention instrument may for example be a well-logging probe. It may be connected electrically to the surface by a well-logging cable, or it may not be connected to the surface, comprising in this case a self-contained power supply and a memory for storing the data.

2. Description of the Prior Art.

It is already known from U.S. Pat. No. 4,349,072 to lower, at the end of a cable into the vertical and deflected part of a well, a probe fixed to the lower end of an extension which may reach a length at most equal to the length of the drain (for example about 500 to 1300 m). In its upper part the extension is connected to a propulsion system generally called a "locomotive", formed of cups whose rubber lining provides substantially total sealing with the inner walls of the tubing. This locomotive is itself attached to the cable.

When the weight of the assembly is not sufficient for lowering the equipment into the pressurized well, the volume situated above the locomotive is pressurized by pumping, so as to push the equipment (probe and extension) into the deflected zone which interests the producer. The measurements are made during the pushing phase when the probe is in the production zone, or during the rising phase. These measurements may be advantageously repeated.

Because of the seal provided by the linings, it is not possible for the fluid to flow freely and rise to the surface. Under these conditions, flow rate measurements, for example, in a well under production become impossible, unless a second tubing is used and is reversed for the rising fluid, but this solution is costly and must be provided during equiping of the well, for the operation of lowering two tubings must be simultaneous.

Moreover, the whole of the equipment (probe, extension and locomotive) is raised by pulling on the cable. If the production tubing has a substantially constant diameter and since the linings provide good sealing, a decompression phenomenon may be observed and so aspiration of the fluid, likely to create pressure imbalances, and fluid displacements leading to uncontrolled starting up of production.

It is known more particularly from French Pats. Nos. A-2,473,652 and 2,500,419 to move a probe in a well by means of a liquid fluid pumped from the bottom of the well, passing through the pumping means and flowing through at least one aperture situated above an automatically controlled inflatable sleeve. The fluid will exert a pressure on the sleeve which will therefore advance into the well.

Devices are also known, as described in the U.S. Pat. No. 3,070,167, which comprises members having springs which are expanded or compressed so that these members provide sealing with the tubing and may allow the extension to be pumped into the well.

U.S. Pat. No. 2,122,697 also mentions a sensor lowered by circulation through pumping and which is then anchored at the bottom of the well by means of a deformable membrane and springs; whereas the U.S. Pat. No. 3,104,714 relates to a pumped tool having an electric cable and which comprises shoes which will brake and prevent the tool from rising.

Numerous problems appear in production well-logging when it is a question of the production of blow-out wells, i.e. wells under pressure. There is a problem first of all in introducing the assembly of the tools into a pressurized well.

It is also known to use an air lock (generally having a length of 10 meters or so), at the surface, for lowering and raising in a pressurized deflection well a welllogging probe and an extension, element by element. Each operation requires more especially a series of valve manipulations, pressurizing and drain operations which are long and tiresome, to the extent that an extension must be assembled for reaching 300 to 500 meters for example.

It is also known to lower a probe and an extension into a pressurized well by snubbing in which each of the elements of the tubing, after being screwed, is forcibly moved from the surface by a hydraulic cylinder. They may be also introduced by coil tubing in which the continuous tubing is wound on a large drum and is driven into the pressurized well by rollers disposed at the surface. Such equipment is heavy and costly, even fairly fragile, more especially the coil tubing.

Finally, it is quite possible to meet variations of diameter in the production tubing during the advance of the well-logging equipment.

SUMMARY OF THE INVENTION

Such drawbacks are considerably reduced and such problems advantageously solved by using a device in accordance with the present invention, usable for carrying out, during fluid injection or production operations, measurements or interventions in a deflected well passing through a geological formation, said well being equipped with tubing. The device comprises at least one measuring or intervention instrument fixed at one end of an extension whose other end forming the upper end, is provided with sealing members allowing the device to be propelled in said tubing under a hydraulic pressure effect, the device being further connected to the surface by a flexible line such as an electric cable feeding the probe.

The device of the invention has a position for propulsion in the tubing and a position for measurements or interventions and the device comprises means supporting the sealing members, the means being adapted on the one hand for uncovering at least one opening allowing the fluid to flow all along the tube and the extension in the measurement or intervention position of the device and, on the other hand, for closing the opening in the propulsion position.

In a preferred embodiment, the means comprise two elongate elements one of which is fixed to the upper part of the extension and comprises at least two openings situated on each side of the sealing members and the other of which is mobile, comprises a least one opening situated above the sealing members and may be moved by sliding, under the effect of a pull exerted on the cable, or by a member remotely controlled from the surface, for example a motor, from a first position corresponding to closure of the openings to a second position which uncovers said openings.

In a particularly advantageous embodiment, the means comprise at the upper part of said extension a membrane defining an annular chamber of variable volume, said chamber being connectable to an auxiliary pressurized fluid source for giving to said volume a value ensuring substantial sealing and allowing propulsion by injection of fluid from the surface, said chamber being also able to be placed under depression so as to allow the flow of injection or production fluid in said tubing, about said membrane and means for adjusting the pressure in said chamber.

The invention is more particularly applicable when the wells passing through the geological formation are deflected through an angle such that the probe cannot be lowered by gravity and, for example, by an angle of more than 40° with respect to the vertical.

When the device is used in non blow-out wells, injection measurements may be made. Under these conditions, a pull on the cable frees the openings of the device of the invention and the injected fluid may flow. The measurements are made during the injection phase, preferably by raising the whole of the equipment (the opening being thus maintained). On the other hand, in the case of blow-out wells at low or high pressures, the flow rate measurements, for example, are made while the fluid is produced which will then be recovered at the surface.

The upper mobile part of the extension comprising the opening may also be moved by means remote controlled from the surface, such as an electric control actuating a motor.

The uncovered opening has a section substantially equal to the section between the tubing and the extension so as to minimize pressure losses.

The means supporting the sealing members comprise anchorage on the flexible line at a point such that the length of said flexible line in the extension allows the opening to be uncovered. It is for example at least equal to the length of the extension to which is added the length of the opening along the axis of the well.

The upper element sliding with respect to the lower element may comprise locking systems, for example electromechanical systems, remote controlled from the surface for maintaining the opening in the closed position during pumping, during lowering of the equipment, or for maintaining the opening in the open position during raising of the equipment and during the production and measurement phase.

The means for adjusting the pressure in the variable volume chamber may comprise a compensation chamber in communication both with the inside of the tubing and with the auxiliary fluid source.

The invention also relates to equipment useable for carrying out, during fluid injection or production operations, measurements or interventions in a well passing through a geological formation, this equipment comprising in combination a device such as described above and a remote control sub-surface valve, through which the device may slide in the open position of this valve.

The valve may define with the surface an air lock of a length equal to the length of the device.

BRIEF DESCRIPTION OF THE DRAWINGS

The invention will be better understood from the following description illustrated by the accompanying drawings in which.

DESCRIPTION OF THE PREFERRED EMBODIMENTS

Figure 1:
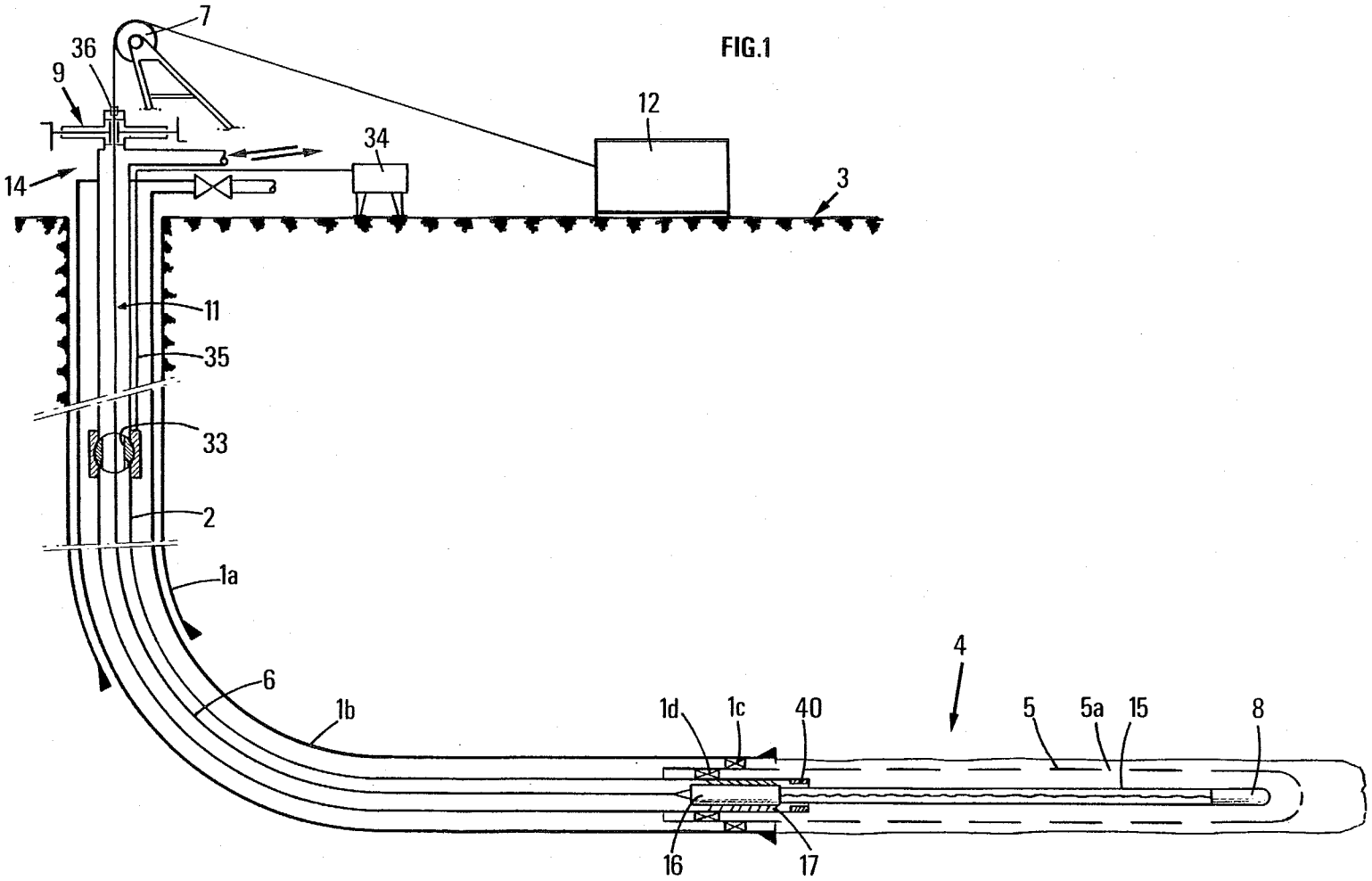
FIG. 1 shows the environment of the device of the invention.

FIG. 1 shows a well 1 equipped with a first tubing 1*a* having an inner diameter for example equal to 40 cm, vertical from the surface 3 and which is deflected in its end part.

Another tubing 1*b*, for example of 24 cm, contained in the first tubing is lowered into the deflected part of the well, the space between the two tubings being cemented. This tubing 1*b* is extended by a third tubing 5 of about 18 cm in diameter which comprises holes 5*a* for recovering the production of a horizontal drain 4. A tubing support 1*c* provides connection with tubing 1*d* and tubing 5, whereas a seal 1*d* is made between tubing 5 and the production tubing 2 of about 8 cm, at the end of which is situated a restriction or "nogo" 40.

Extension 15 and probe 8, for example, have been pumped, that is to say pushed by a fluid (gas-oil for example) into tubing 2, by means of a locomotive 16, from the surface.

On the surface, a control cabin controls the handling, lifting and fluid pumping operations. A traction cable 6 (diameter for example of 8 mm), driven by a winch 7, is connected to a probe support and to a well-logging probe 8 of standard type (diameter 4.3 cm for example) which may be self contained or connected by an electric cable to the surface, this latter being also able to be the pulling cable. The pulling cable also supports the extension elements.

The surface equipment comprises:

a blow out plug 9 or BOP formed of plugs equipped with jaws providing sealing on the bodies of closure tubes equipped with retaining wedges and a plug equipped with jaws providing sealing on cable 6, snubbing type pressure equipment, not shown in the Figure; by snubbing is meant means for lowering tubular material under pressure, an air lock 11 limited by the equipment of the blow out plug 9 at the surface and a sub surface valve 33 disposed in tubing 2, at a depth such that the length of the air lock is substantially greater than that of the extension which it is desired to introduce into the deflected portions 5 of the well, a system of pumps providing, through well head connections 14, pumping of a fluid for lowering the probe and pumping of the product fluid.

The well-logging probe 8 and its support are fixed, either to screwed elements of the snubbing or to the coil tubing (flexible tube wound on a reel) which form the extension 15, of a diameter close to that of a probe and of a length, for example, between 100 and 500 mm and connected possibly to the surface by an electric probe-surface connection through a single connector at the level of the probe or through a multiplicity of connectors, each being disposed substantially in the vicinity of each element.

The propulsion means, the assembly of screwed elements, the probe support and the well-logging probe have preferably a diameter less than the opening diameter of the valve.

Figure 2:
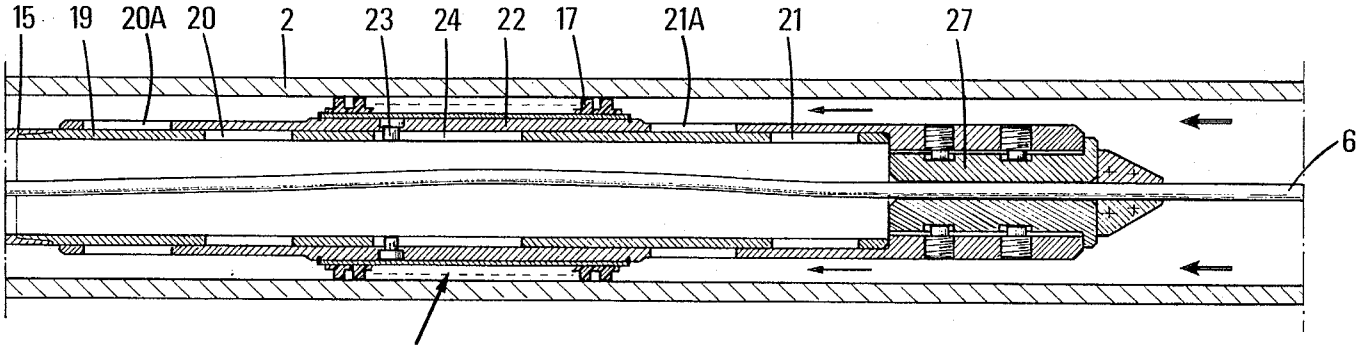
FIGS. 2 and 3 illustrate a detailed view of the device during the pumping phase and the measuring phase.

At the upper end of the extension is to be found the device of the invention illustrated in FIG. 2, with the propulsion system 16 or locomotive comprising one or more sealing elements 17 (or cups) for providing sealing with the production tubing 2, this device fixed to the cable 6.

Figure 3:
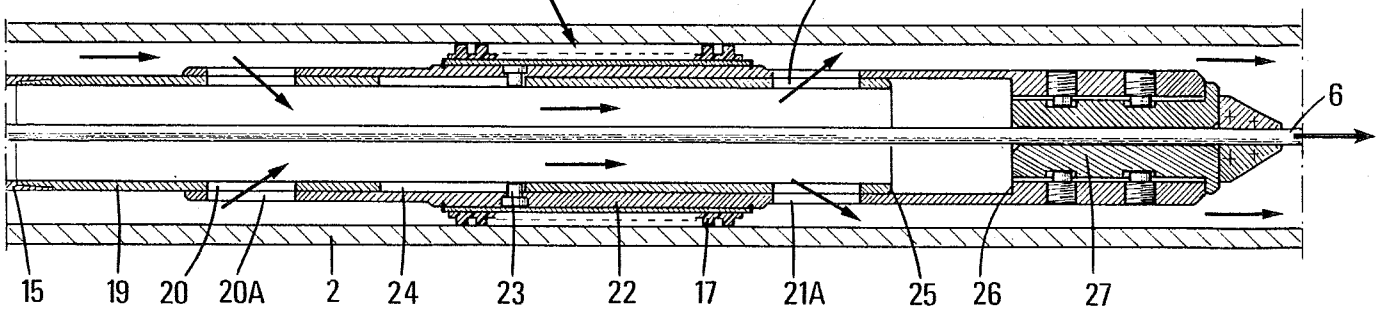

FIGS. 2 and 3 show an advantageous embodiment of the device of the invention.

The upper element of extension 15 comprises a screwable prolongation 19 having an inner diameter substantially equal to that of the extension. The lower part of this prolongation is provided with at least a first lateral hole 20 for allowing, if required, fluid to flow through the prolongation; its upper part is also provided with at least a second lateral hole 21 through which the fluid is discharged towards the surface. Each of these openings is situated on each side of the position of locomotive 16. The role of these openings 20 and 21 may be reversed, if injection work is to be carried out.

The mobile element or sliding liner 22 comes and covers the prolongation 19. This liner comprises two openings **20*a* and 21*a* situated on each side of the locomotive. It is fixed to cable 6 in its upper part and a pin 23 housed in an antirotation groove 24 only allows axial movement of the sliding liner 22 when cable 6 is subjected to a traction force from bottom to top. Cable 6 was fixed at the surface to the sliding liner 22 at an anchorage point 27**, after having taken the precaution of leaving a little slack so as to allow the sliding liner to move.

A sliding means for the liner comprises a sealing cup 17 of locomotive 16. In the pumping position, it rests at 26 on the low stop 25 of the prolongation 19 of the extension and thus closes off the openings 20, **20*a*, 21 and 21*a* thus preventing any fluid flow. During production of the fluid (FIG. 3) a pull on the cable causes the liner 22 to rise as far as the stop formed by pin 23** and the openings are freed. The fluid may then flow.

Figures 3A, 3B:
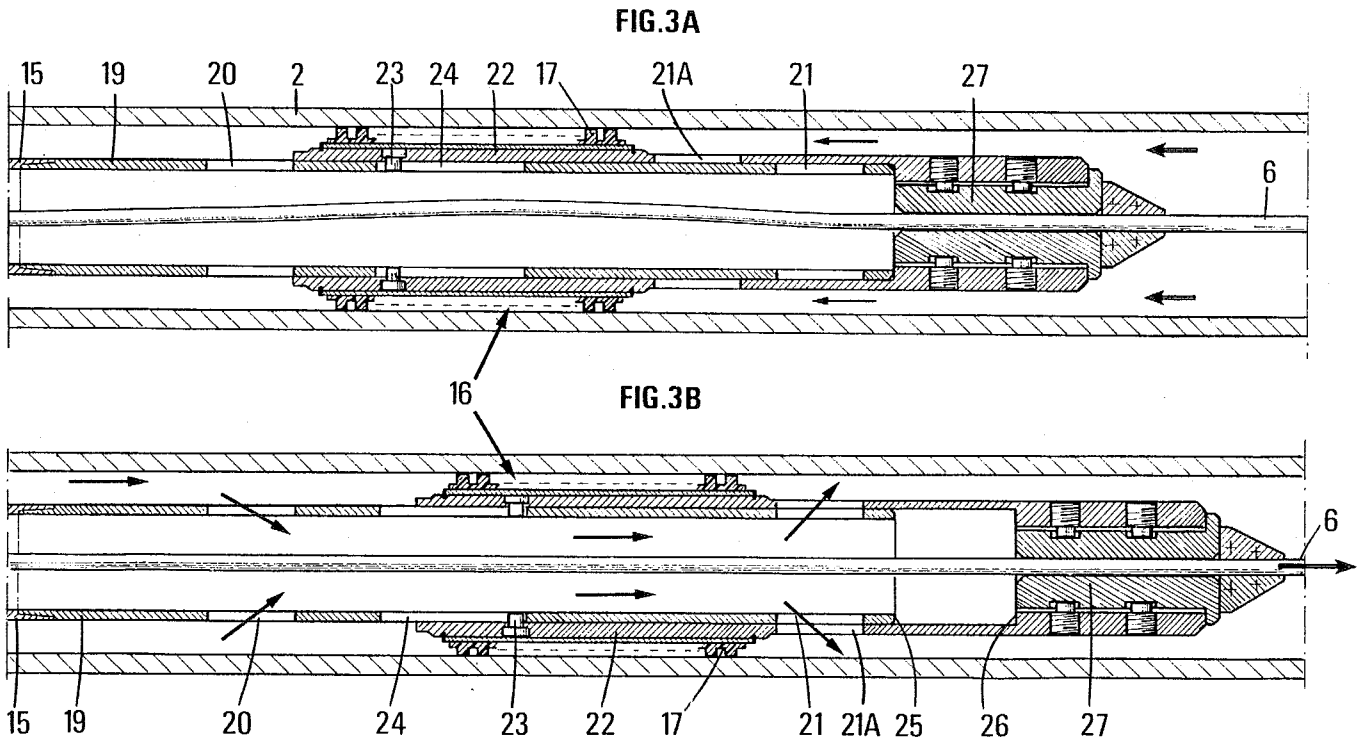
FIGS. 3A and 3B show a variant of the apparatus of the invention.

FIG. 3A illustrates another particularly advantageous embodiment in which the opening 20 through element 19 remains permanently open, the sliding liner 22 only covering openings 21.

The section of the fluid inlet and outlet openings is preferably substantially equal to the section of the annular space between tubing 2 and extension 15, so as to minimize the pressure loss.

Figure 4A:
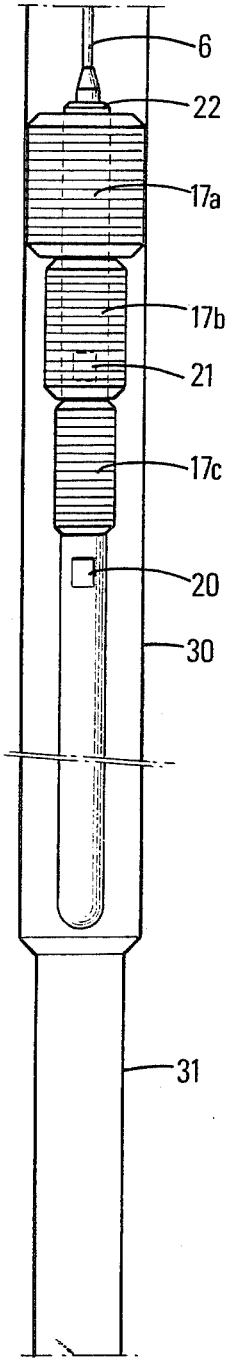
FIGS. 4A and 4B illustrate the general view of the extension and of the device of the invention in the case of production tubings of different diameters.
Figure 4B:
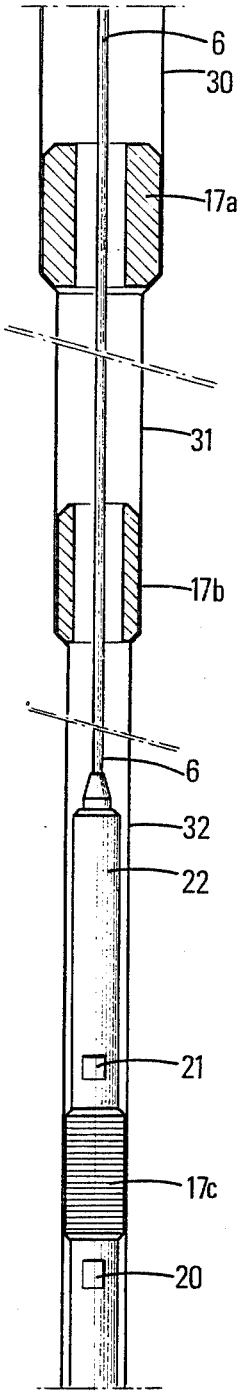

In a particularly advantageous embodiment (FIG. 4A), when the production tube comprises elements of decreasing diameter, for example three elements A, B C (30, 31, 32) of respective diameters $\phi_A$, $\phi_B$, $\phi_C$, such that $\phi_A > \phi_B > \phi_C$, the pumping operation may be carried out over several stages of cups **17*a*, 17*b*, 17*c* of different diameters, each stage stopping at the level of the restriction considered. Only the stage 17*c* of the smallest diameter $\phi_C$ comprises a sliding liner 22 which allows production of the fluid and the corresponding production measurements to be carried out (FIG. 4B**).

FIG. 1 illustrates an artificial air lock 11 and more particularly the sub-surface valve 33 disposed in the production line 2. This valve ensures safety and air lock-surface equipressurization during the assembly and disassembly phases of the probe and of the extension and of the device of the invention, and air lock-well equipressurization during the lowering and raising phases of the whole of the equipment.

A manual remote control transmits energy from the surface to valve 33 through either a hydraulic or gas unit 34 and a duct 35 so as to open it or close it at will during the different operational phases and especially so as to prevent any uncontrolled closure following an over pressure, which would cause breakage of the cable if the probe and the extension were already engaged under the valve. Of course, the valve is also of an automatic closure type so as to comply with the safety standards in force.

When the pressure of the well is low, but sufficient for production purposes, it is possible to "kill" the well with an appropriate brine and to avoid using a sub-surface valve, the well-logging equipment being lowered by gravity and possibly by pumping in the deflected part of the drain.

A particularly advantageous embodiment of the invention is described hereafter.

A sub-surface valve 33 is disposed beforehand in a production tubing 2 at a distance at least equal to the length between the well head and the end of the probe, namely about 300 m. This valve is permanently open, with closure control, or it may be permanently closed, with opening control. The valve is closed. The air lock thus created is at atmospheric pressure. The following are introduced successively, the measuring probe 8 fixed to cable 6, then extension 15, element by element, and the propulsion system 16, 17 and 19 mounted on the device and the invention. An electric connection is formed possibly by means of a bottom connector. The packing 36 about the cable is closed at the surface and the pressure is balanced on each side of valve 33 and then it is opened by remote control from the surface. The probe and the extension are moved by gravity then by pumping, into the production stringer 2. With cable 6 connecting the extension to the surface the depth may be checked at any time as well as the movement of the extension and the lowering speed. The extension may be by pulling on the cable. A substantial increase in pressure detectable at the surface means that the locomotive has arrived in contact with the restriction or "nogo" 40 disposed at the lower end of the production tubing 2.

The extension and the probe are then in the production drain 4. By pulling on the cable, the sliding liner 22 is moved without touching the rest of the equipment, since the cable has a little slack inside the device. This operation allows the fluid to flow through the holes **5*a* of the production zone and from there to the surface and to pass through the openings 20 and 21** thus freed in the device of the invention. Thus measurements may be carried out, for example flow rate measurements, using the production tubing which served for moving the probe and the extension.

The probe and the extension may be moved by pushing or pulling the cable. The measurements may then be stationary, or made continuously during the movement, so as to define a dain flow-pattern.

It is particularly advantageous to repeat the movement of the probe in the production zone several times and so to repeat the measurements by first of all pumping for moving the assembly and then by pulling the cable.

Figure 5:
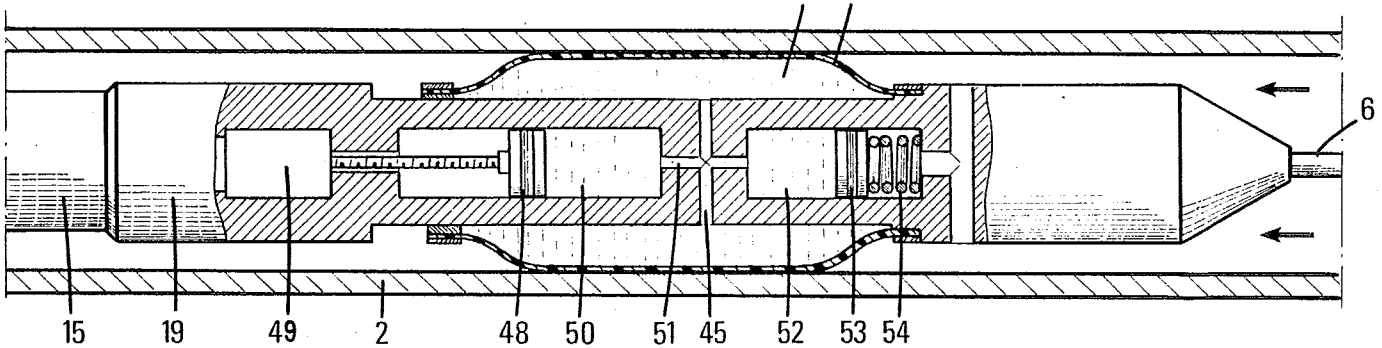
FIGS. 5 and 6 show a detailed view of another embodiment of the invention.
Figure 6:
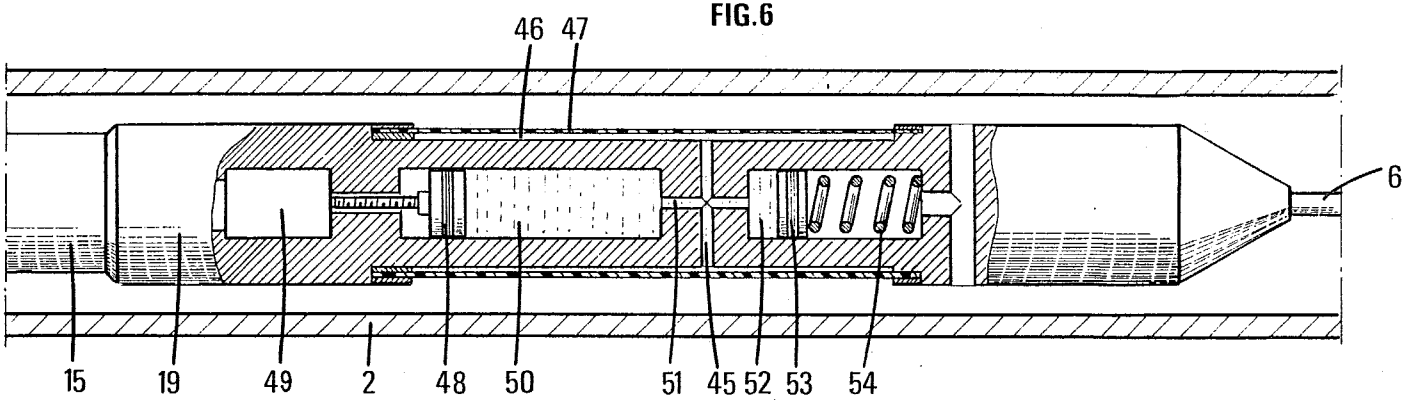

Once the recordings are made, the probe-extension assembly and the propulsion system are raised without decompression since the sliding liner is open and since the fluid may be transferred from the upper part to the lower part of the propulsion system. With the assembly raised above the sub-surface valve 33, this valve is closed and the air lock drained. A variant of the device of the invention is particularly advantageous when the tubing has variations of diameter is illustrated in FIGS. 5 and 6. It comprises an extension prolongation 19 fixed both to cable 6 and to the upper part of the extension. This prolongation is provided laterally with at least one hole 45 through which an auxiliary fluid flows (oil or viscous grease or gas) which will be accomodated in a annular chamber of variable volume 46 defined by a polymer membrane 47 and the prolongation. This viscous fluid is caused to flow in a duct 51 by means of a piston 48 which is driven by a motor 49 and which moves in a reservoir 50. Another chamber 52, called a compensation chamber, sends in the reverse direction by means of another piston 53 on which bears a compressed spring 54, an amount of fluid which flows through another duct 51 in relation with at least one hole 45 and which allows the pressures to be balanced between the fluid contained in the production tubing 2 and the auxiliary fluid. Before pumping the extension and the probe into the well, the piston is controlled for sending the auxiliary viscous fluid into the volume of the annular space defined by the membrane thus providing sealing against the production tubing. Another embodiment of the propulsion system is thus formed and pumping of the equipment may take place quite correctly.

For making measurements during injection or production, it is sufficient to partially empty the variable volume of the annular chamber 46 so that the fluid may flow freely.

A diameter control means coupled to the motor may be advantageously mounted upstream or downstream for passing over possible restrictions or variations of diameter the in the tubing likely to be met with.

It would still be within the scope of the invention to use device variants based on the above indicated means.

What is claimed is:

1. A device useful for carrying out, during a fluid production or injection operation, measurements or interventions in a deflected well passing through a geological formation and being equipped with tubing, said device comprising at least one measuring or intervention instrument, an extension having an upper end provided with means for supporting sealing members allowing propulsion of the device in said tubing under the effect of a hydraulic pressure and another end fixed to the instrument, said device being connected to the surface by a flexible support line and having a propulsion position in the tubing as well as a measuring or intervention position; said support means comprising two elongate members, one of the elongate members being fixed to the upper end of said extension, extending above said sealing members and defining a flow passage which leads from at least one opening therein situated above the sealing members to at least another opening therein situated below the sealing members and the other elongate element being mobile and having at least one opening therein situated above the sealing members and being capable of being moved by sliding with respect to said upper end of said extension from a propulsion position in which the at least one opening in the fixed elongated element situated above the sealing members is closed to a measuring or intervention position in which the at least one opening in the fixed elongated element situated above the sealing members is uncovered thereby allowing a fluid to flow and to pass through said passage and through said elongated elements during injection or production of the fluid.

2. The device according to claim 1, wherein said one elongate element comprises at least two openings situated on each side of said sealing members and said mobile elongate element may be moved by sliding with respect to said one elongate element which is fixed to the upper end of said extension from a first position corresponding to closure of the at least one opening of said mobile elongate element situated above said sealing members to a second position uncovering said at least one opening situated above said sealing members.

3. The device according to claim 2 or claim 1, wherein said mobile element may be moved by sliding under the effect of a pulling force exerted on said flexible line.

4. The device according to claim 2 or claim 1, wherein said mobile element may be removed by sliding by means of a member remotely controlled from the surface.

5. The device according to claim 1, wherein said flexible line is an electric cable electrically connected to the probe.

6. The device according to claim 1, wherein the fixed elongate element and the mobile elongate element are tubular elements arranged coaxially, one end portion of the fixed elongate element being positioned to be positioned within said mobile elongate element and the other end portion of the fixed elongate element being connected to the upper end of the extension; said sealing members being supported by a wall portion of the mobile elongate element.

7. The device as claimed in claim 1, wherein the at least one uncovered opening situated above the sealing members has a diameter at least equal to spacing formed between said tubing and said extension when said extension is positioned within the tubing.

8. Equipment useful for carrying out, during fluid production or injection operations, measurements or interventions in a well passing through a geological formation and being equipped with tubing, which comprises, in combination, a device as claimed in claim 1, and a remote control sub surface valve connected to said tubing, said valve having an open position through which said device may slide into said tubing.

9. Equipment as claimed in claim 8, wherein said valve defines with the tubing and means on the surface, an air lock of a length at least equal to the length of the device.

* * * * *